US007894732B2

(12) United States Patent
Denton et al.

(10) Patent No.: US 7,894,732 B2
(45) Date of Patent: Feb. 22, 2011

(54) IR FLUORESCENT TONER COMPOSITIONS

(75) Inventors: Gary Allen Denton, Lexington, KY (US); Kurt Matthew Korfhage, Shelbyville, KY (US); Wilson M. Routt, Jr., Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 87 days.

(21) Appl. No.: 12/039,196

(22) Filed: Feb. 28, 2008

(65) Prior Publication Data

US 2009/0220260 A1 Sep. 3, 2009

(51) Int. Cl.
*G03G 15/00* (2006.01)

(52) U.S. Cl. ..... 399/49; 252/301.36

(58) Field of Classification Search ..... 399/49; 524/413; 252/301.36
See application file for complete search history.

(56) References Cited

U.S. PATENT DOCUMENTS 4,070,577 A 1/1978 Lewis et al.
4,756,991 A 7/1988 Grubb
4,865,937 A 9/1989 Santilli et al.
5,091,006 A 2/1992 Sarada et al.
5,105,451 A * 4/1992 Lubinsky et al. ..... 378/28
5,330,868 A 7/1994 Santilli et al.
5,357,317 A * 10/1994 Fukuchi et al. ..... 399/39
5,397,819 A 3/1995 Krutak et al.
5,461,136 A 10/1995 Krutak et al.
5,553,714 A 9/1996 Cushman et al.
5,554,480 A 9/1996 Patel et al.
5,959,296 A 9/1999 Cyr et al.
6,235,442 B1 5/2001 Everaars et al.
6,291,121 B1 9/2001 Hollenbaugh, Jr. et al.
6,331,372 B1 12/2001 Livengood et al.
6,463,227 B1 * 10/2002 Denton et al. ..... 399/49
6,492,083 B1 12/2002 Livengood et al.
6,861,193 B1 3/2005 Golodetz
6,957,024 B2 10/2005 Shinkawa et al.
6,991,884 B2 1/2006 Sun et al.
2005/0014283 A1 * 1/2005 Matsuura et al. ..... 436/166

* cited by examiner

*Primary Examiner*—David P Porta
*Assistant Examiner*—Benjamin Schmitt

(57) ABSTRACT

A toner patch including a toner having a given excitation wavelength and a given emission wavelength may be deposited onto a control surface. Light may be provided onto the toner patch and at least a portion of emitted light may be detected from the toner patch at the given emission wavelength by a detector. Furthermore, an operating parameter may be adjusted based on the detected emitted light.

17 Claims, 7 Drawing Sheets

IR FLUORESCENT TONER COMPOSITIONS

CROSS REFERENCES TO RELATED APPLICATIONS

None.

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally to IR fluorescent toner compositions which may improve toner patch sensor accuracy and print quality.

2. Description of the Related Art

Toner patch sensors may be utilized to provide closed loop process control in image forming devices. A series of solid or half-tone test patches may be printed onto a control surface, e.g., an intermediate transfer belt or the photoconductor, in the image forming device. The toner patch sensor may emit light in at a given wavelength or range of wavelengths and detect incident light, which has been emitted from the test patches, at the emitted wavelengths. The toner patch sensor may then provide signals indicative of the reflectivity of the test patches. These signals may then be correlated to toner layer thickness or mass density, which refers to the mass of toner in a given area, as well as to values relating to, e.g., L* or luminance, quantifying the visualized printed image. Upon comparison of the realized printed image to the desired image, adjustments may be made to process parameters, such as photoconductor bias or developer roller bias, as well as adjustments to half-tone patterns.

The control surfaces, however, may be subject to abrasion and impact of toner particles as well as their associated extra-particulate agents. The deterioration may lead to changes in the quantity of light reflected from the belt as well as the direction in which the light may be reflected. These changes may, therefore, change the accuracy of the toner patch measurements and/or affect print quality in the system.

SUMMARY OF THE INVENTION

An aspect of the present disclosure relates to a method of monitoring and adjusting the amount of toner deposited per unit area or toner layer coverage. The method may include depositing a toner patch including a toner having a given excitation wavelength and a given emission wavelength onto a control surface. In addition, the method may also include providing light onto the toner patch by a light source, detecting at least a portion of the light emitted from the toner patch at the given emission wavelength by a detector. An operating parameter may then be adjusted based on the detected emitted light.

Another aspect of the present disclosure relates to a system for detecting toner layer coverage. The system may include a toner composition having a given excitation wavelength and a given emission wavelength. The system may also include a toner patch sensor capable of providing light from a light source onto the toner and detecting at least a portion of the light emitted from the toner at the given emission wavelength by a detector and generating a signal and a controller capable of receiving the signal and varying an operating parameter based on the signal.

In yet another aspect, the present disclosure relates to a toner composition for use with a toner patch sensor. The toner may include a resin binder and a colorant, wherein the colorant is excited at a first wavelength $W_e$ and emits light at a second wavelength $W_r$, wherein $$W_r=(0.5-0.7)*W_e.$$

A further aspect of the present disclosure relates to an article comprising a storage medium having stored thereon instructions that when executed by a machine result in the following operations of providing light onto a toner patch including toner comprising a luminescent colorant, detecting at least a portion of the light emitted from the toner patch at the given emission wavelength, and adjusting an operating parameter based on the detected emitted light.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

DETAILED DESCRIPTION

Figure 1:
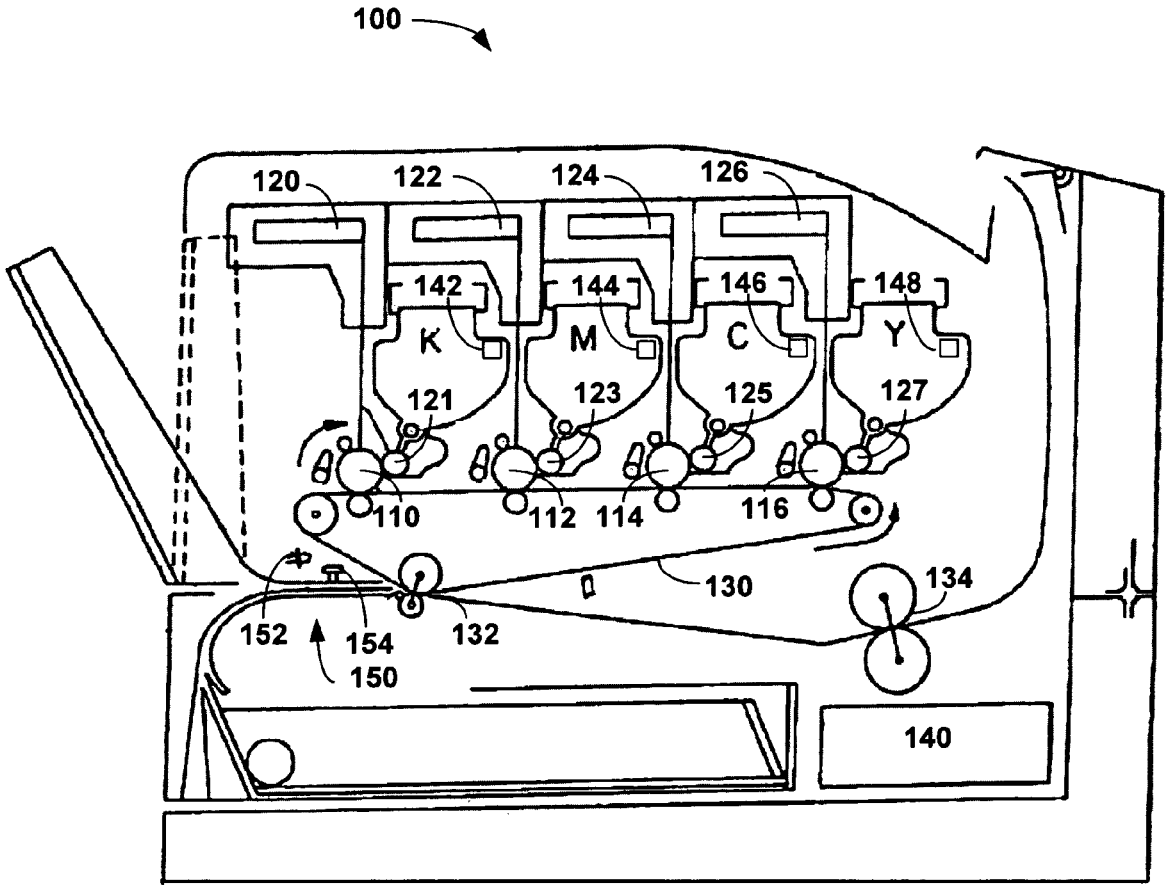
FIG. 1 is an example of an image forming apparatus including a toner patch sensor.

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled," and "mounted," and variations thereof herein are used broadly and encompass direct and indirect connections, couplings, and mountings. In addition, the terms "connected" and "coupled" and variations thereof are not restricted to physical or mechanical connections or couplings.

The present disclosure provides a toner composition, system and method for controlling output quantity of printed toner based upon the detection of luminescence or light emitted from the toner at a given wavelength in the range of 700 to 3000 nm, including all values and increments therein. The luminescence may then be specifically detected by a toner patch sensor which as noted, may then provide information regarding toner layer thickness or mass density, as well as values relating to L* or luminance. As understood herein, a given wavelength may refer to one wavelength or a spectrum, i.e., a distribution of wavelengths. The toner composition may be utilized to form one or more images via an image forming device, such as a printer, fax machine, copier, all-in-one device or multi-functional device. Such toner compositions may include conventional toner, which may be mechanically processed, or chemically processed toner (CPT).

Toner compositions may generally include a resin binder (e.g. a polymeric resin), a wax, a colorant and optionally additives. Colorants may generally be understood as pigments and/or dyes that may be perceived and/or detected in the visible spectrum, i.e., at a given wavelength in the range of about 400 to 700 nm, including all values and increments therein. Such colorants may include dyes or pigments forming cyan, magenta, yellow or even black. The toner compositions may be configured to be luminescent and suitable for detection by a toner patch sensor, due to the use of any one or more of the toner ingredients (resin, wax, colorant or additive) that is then capable of luminescence to a given wavelength of light. For example, it is contemplated that one may utilize a polymeric resin binder that may contain a backbone (repeating unit) and/or grafted functionality (e.g. pendant side group) that is capable of Tumescence. However, in certain particular embodiments herein, the use of luminescent colorants may be preferred.

One example of image forming device includes the printer illustrated in FIG. 1, which is capable of depositing these toner compositions onto a surface to form images. The toner compositions may be supplied in image forming cartridges, K, M, C, Y. When a print request is received by a controller 140, photoconductors 110, 112, 114, 116, may be charged to a desired voltage. Then a discharge device, such as lasers 120, 122, 124, 126, may selectively discharge the photoconductors to form a latent images thereon.

Toner may then be deposited onto the photoconductors 110, 112, 114, 116, by developer rollers 121, 123, 125, 127, also having a desired charge to facilitate electrostatic transfer of the toner from each toner cartridge to its respective photoconductor. In image forming devices having more than one photoconductor, as illustrated herein, the latent image formed on each photoconductor may correspond to a different aspect or color of the desired image. Upon transferring the image to a surface, such as a sheet of media or an intermediate transfer belt 130, the various colors may be positioned to form a single multi-color image. If at this point, the toner image is not transferred to a sheet of media, the image may be transferred by a transfer device 132 onto the media and the image may be fused by a fixing device 134.

As alluded to above, a toner patch sensor (TPS) 150 may be provided in the image forming device 100 to assess the quantity of toner deposition and provide feed back to the controller to adjust operating parameters to provide a more desirable image. To assist in TPS detection, the toner compositions herein may now utilize colorants (pigments and/or dyes) that are luminescent in the infrared region (700 nm to 3000 nm), which luminescence may be provided by stimulating light or excitation light provided by the TPS over a first given wavelength or range of wavelengths. Luminescence is discussed more fully below. Accordingly, the luminescent light or light emitted from the toner may then be detected by the TPS detector over a second given wavelength, wherein the second given wavelength may be different than the first given wavelength. Accordingly, the toner patch sensor may include a light source 152 providing light at a given wavelength in the range of about 700 nm to 3,000 nm, including all values and increments therein. Furthermore, the toner patch sensor may include a detector 154, such as an optical detector, which may be sensitive to the emitted or luminescent light having a given wavelength in the range of about 700 nm to 3,000 nm, including all values and increments therein.

As alluded to above, luminescent colorants may be incorporated into a given toner to provide luminescence or photoluminescence. Luminescence or photoluminescence may be understood herein as a process in which a composition may absorb photons, or electromagnetic radiation, triggering or leading to the emission of another photon, or photons, from the composition at different wavelengths having varying intensity. Luminescence may generally refer to and include both fluorescent and phosphorescent effects. Fluorescence may be understood as relatively fast luminescence, exhibiting decay on the order of nanoseconds to milliseconds. Phosphorescence may be understood as luminescence exhibiting a relatively longer emission of the electromagnetic energy.

Figure 2A:
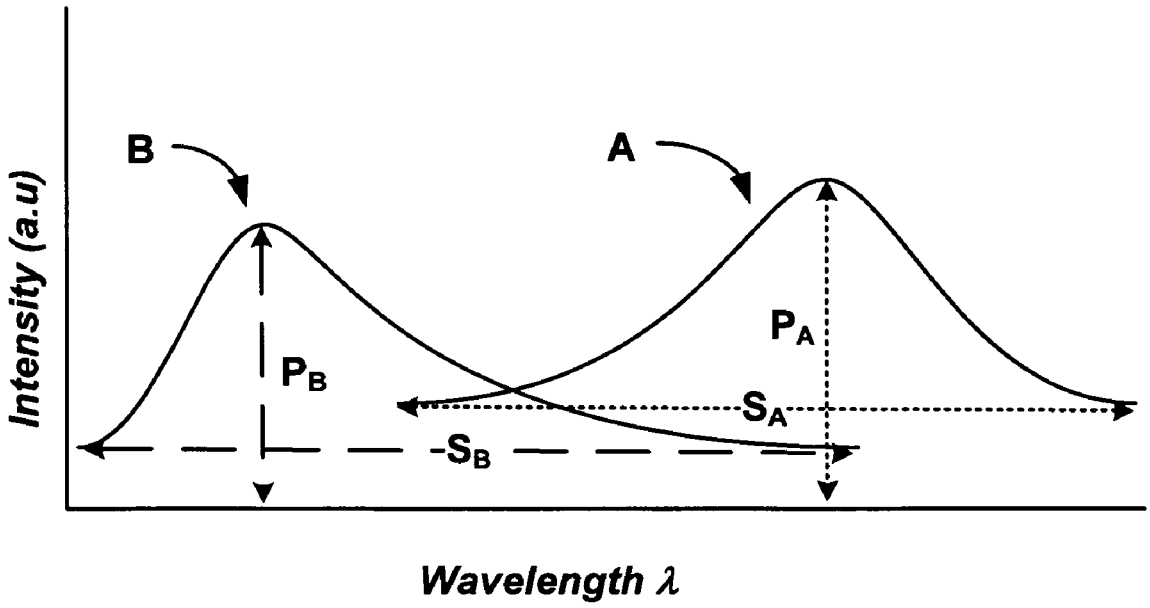
FIGS. 2*a* and 2*b* are examples of a plot of excitation and emission wavelength versus intensity of a luminescent material.
Figure 2B:
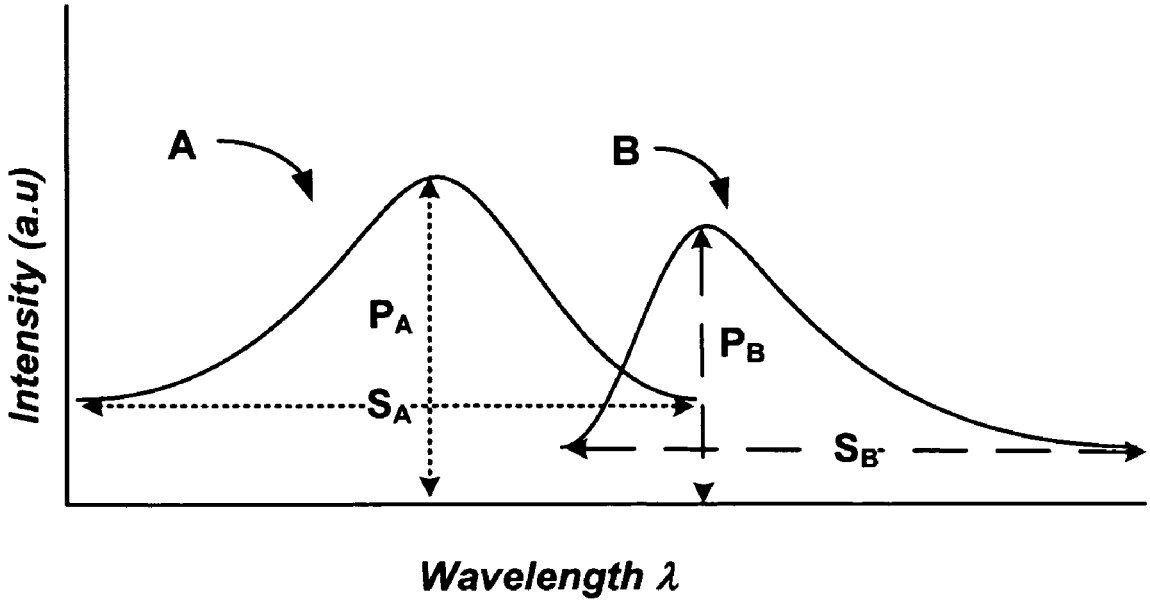

Luminescent toner compositions suitable for detection by a toner patch sensor may have a relatively unique absorption and emission characteristics. For example, luminescence may be characterized by a number of factors such as the given excitation or stimulating wavelength, the given emitted wavelength, the intensity of the emitted light, the decay time and/or the change in intensity during decay. FIG. 2 illustrates an exemplary plot of a given excitation wavelength spectrum "A" and a given emission wavelength spectrum "B" for a given toner versus intensity for a given toner composition. The given emitted wavelength may differ in spectral range and intensity from the excitation wavelength and intensity. For example, as illustrated in FIG. 2*a*, the emitted wavelength spectrum may be shifted and the wavelengths reduced, changing the shape of the curve. Furthermore, in some instances, the overall emitted wavelength spectrum may be shifted to a higher or longer wavelength spectrum than the excitation wavelength spectrum. See FIG. 2*b*. Moreover, the excitation and emission wavelength spectrums may overlap. For example, the peak excitation wavelength of the toner may be at least 100 nm greater than 1150 nm and the peak emission wavelength may be at least 100 nm less than 1150 nm. Difference in the excitation and emitted wavelengths may be understood as a difference in either the peak value P of the wavelength or spectrum S when more than one wavelength is present. See again, FIGS. 2*a* and 2*b*.

Figure 3:
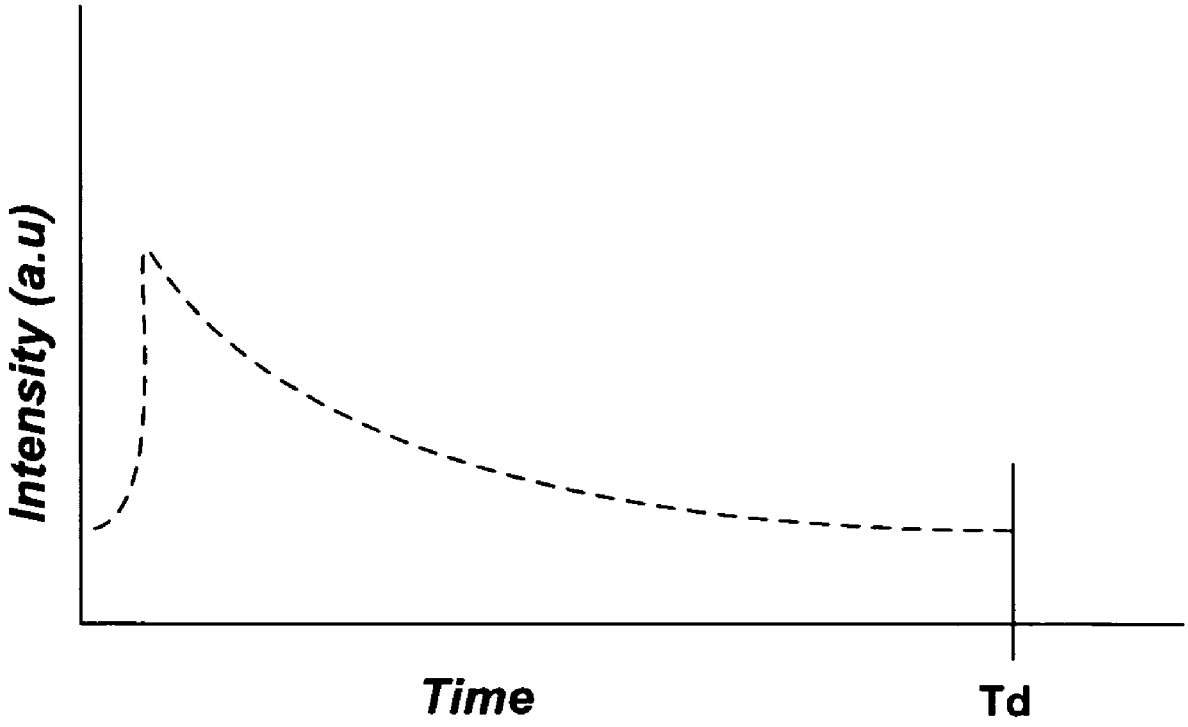
FIG. 3 is an example of a plot of luminescent intensity decay versus time for a luminescent material.

Furthermore, the luminescent toners herein may exhibit a decay in luminescent intensity over a given time period as illustrated in FIG. 3, which is an exemplary plot of time versus intensity for a given toner composition. The duration and intensity of the decay may vary depending on the luminescent composition. In addition, the decay may be utilized, in part, or in combination with the excitation and/or emission spectrum in the toner patch sensor device and again, correlated to toner layer thickness or mass density and/or L* values.

As alluded to above, various luminescent colorants may be utilized in a toner formulation, such as those providing down-conversions as well as up-conversions. Down conversion or Stokes shift may be understood as the absorption of light at a given wavelength and the emission of light at a longer wavelength. For example, KYbW may be utilized as a luminescent colorant exhibiting a down-conversion or a down shift. KYbW may exhibit a 981 nm absorption peak, a 0.232 millisecond decay time and a transmission range of 350 nm to 5.5 microns. Accordingly, the KYbW may be stimulated with light in the range of about 950 nm and emitted light may be detected in the range above 980 nm.

An up conversion or anti-Stokes shift may be understood as the absorption of light at a given wavelength and the emission of light at a shorter wavelength. For example, an anti-Stokes pigment or phosphor may include rare earth activated compounds based on yttrium oxides, fluorides, oxysulphides, or oxychlorides. Such anti-Stokes phosphor may be available from Molecular Technology GmbH of Berlin, Germany under the product number FAM-810/1000-1 ($Y_2O_2S$:Er). Such phosphors may have an excitation band in the range of about 1.5 to 1.6μ and an emission band in the range of about 0.8 to 1.2μ.

Thus, an example of a toner composition may include a fluorescent colorant exhibiting an anti-Stokes shift. For example, the emission peak may be 50-70% of the wavelength of the excitation peak. Therefore, the colorant may be excited at a first wavelength $W_e$ and may emit light at a second wavelength $W_r$, wherein $$W_r=(0.5-0.7)*W_e.$$

The colorant may be present in the range of 0.1% to 10% by weight of the toner composition.

Figure 4:
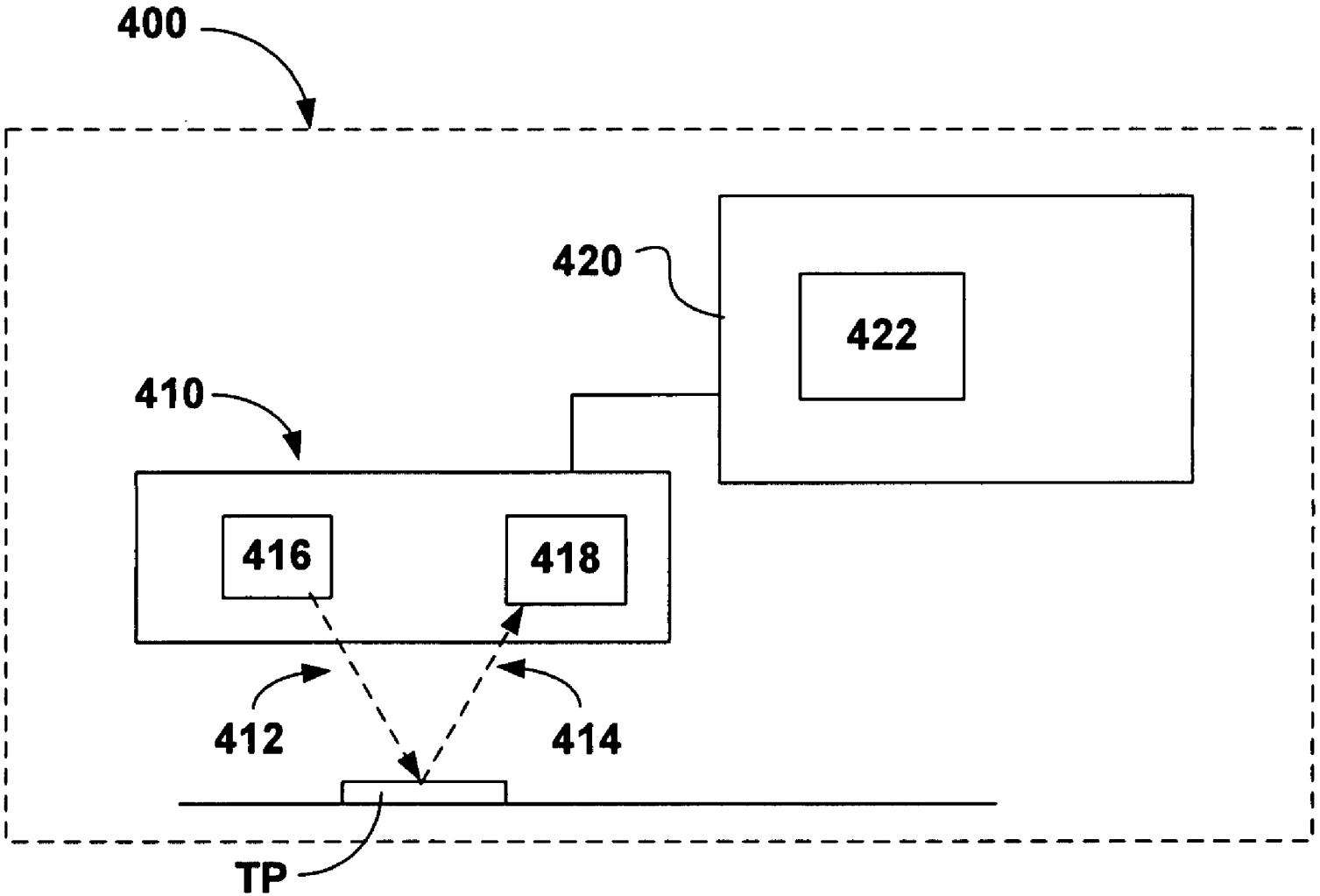
FIG. 4 is a schematic diagram of a toner patch sensor within an image forming device.

In such a manner, a system is contemplated herein utilizing a toner composition including the luminescent colorant in combination with a toner patch sensor as illustrated in FIG. 4, wherein the toner luminescence may be used to adjust the operating parameters of the image forming device. The toner patch sensor (TPS) 410, located in an exemplary image forming device 400, may be adjusted to provide light, such as at given excitation wavelength 412, stimulating the luminescent toner composition. A portion of the light may be absorbed by a toner patch TP and emitted by the toner patch TP. The emitted light may then be detected and the emitted wavelength(s) and/or intensity 414 may be determined.

Light sources 416 may include LED, lasers, incandescent lights, etc. Detectors 418 may include various optical detectors, such as photoresistors, photodiodes, etc. Optionally, the toner patch sensor may be capable of detecting the decay time of the emitted light. The TPS may provide one or more signals, which may be a voltage that may change with respect to the intensity or wavelength of light detected, to a controller 420. The signal may then be processed by a processor 422 located within a controller 420 and used to adjust the operating parameters of the system.

As may be appreciated, detection of the emitted light may be facilitated via modulating or pulsing of the excitation light source, wherein the light source intermittently ceases to provide light. The emitted light may then be detected by the optical detector in the absence of the light provided by the light source. For example, the light source may be turned on and off in a fraction of a microsecond, exciting the luminescent colorant in the toner. A detector may be provided to capture the luminescence detecting short pulses of emitted light at least 100 ns after the light source ceases to provide light. For example, the light source may be driven using a low duty cycle at frequencies of up to e.g., about 10 MHz. A silicon PIN photodiode may then be forward biased to provide a response time of e.g., less than 10 nanoseconds.

Figure 5:
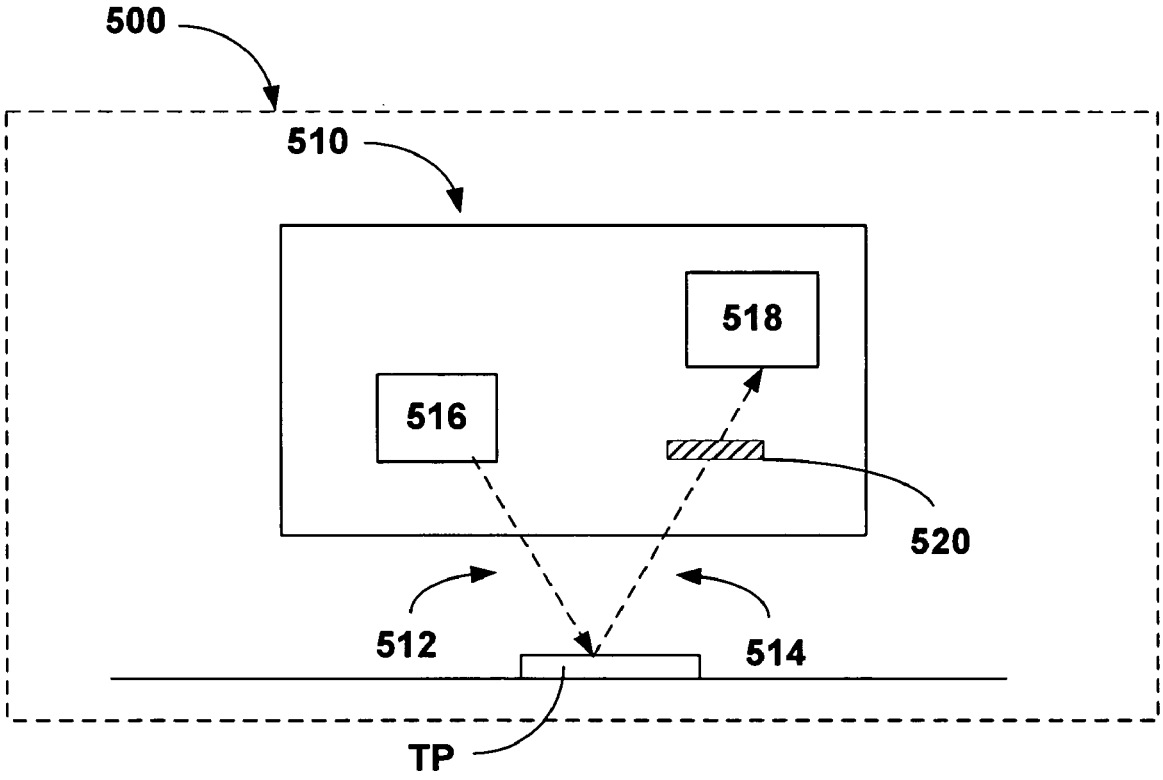
FIG. 5 is a schematic diagram of an example of a toner patch sensor.

In other embodiments, detection of the emitted light may be facilitated by various arrangements of stimulating light source, detectors and/or filters. For example, illustrated in FIG. 5, a light source 516 may be provided capable of providing light 512 at a wavelength near the absorption peak of the luminescent colorant. An optical filter 520 may be provided which may strongly absorb or reflect the stimulating light 512 while being transparent to and passing through the emitted fluorescent light 514. In a further arrangement, detectors 518 may be used which do not detect light provided 512 from a stimulating light source 516, but which may detect the fluorescent light 514 emitted from the toner compositions TP. For example, the anti-Stokes phosphors cited above could be excited by an LED with an emission peak near 1.6μ to produce an emission peak near 0.8μ. A silicon PIN photodiode may detect the emitted light but not the exciting light since it inherently has no response to photons with wavelengths greater than 1.15μ.

Figure 6:
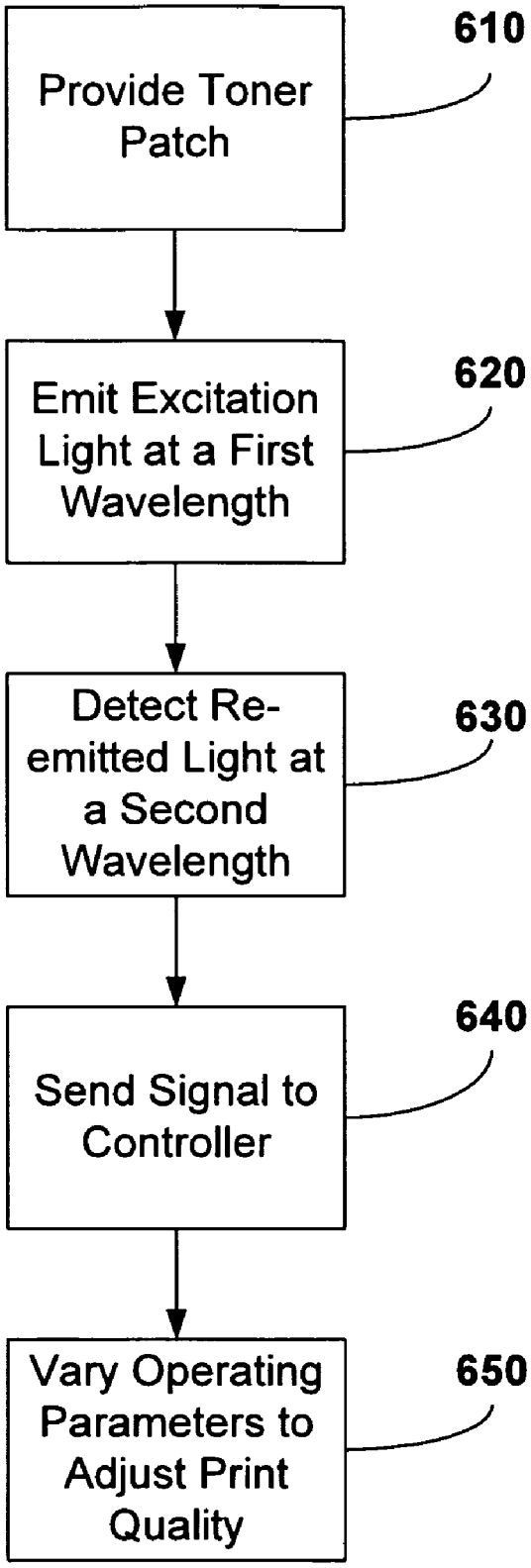
FIG. 6 is a flow diagram of an example of a method of detecting print quality using a toner patch sensor.

A method may therefore be provided for measuring properties of a printed toner composition. The method may be characterized in the flow diagram of FIG. 6, wherein a toner patch may be produced on a control surface 610. Light may be provided by the toner patch sensor at a first given wavelength 620 and a portion of the light may be absorbed and emitted from the toner patch. The emitted light may be detected by the toner patch sensor 630 at a second given wavelength. It may be understood that various characteristics of the light may be measured, such as: (1) the emitted wavelength(s); (2) the intensity of the emitted light; and/or (3) the decay of the emitted light. These measurements may therefore depend on the toner patch sensor device itself, including the optical detector utilized.

Once the TPS detects the emitted light, at least one signal may be sent to a controller including a processor 640. Based on that signal, the controller may vary a number of operating parameters in the image forming device 650. Such parameters may include developer roller bias, photoconductor charge voltage/bias, laser print head beam intensity/power, image formation speed (e.g. pages printed per minute), etc.

Due to the above characteristics of luminescent materials, i.e., excitation wavelength(s), emission wavelength(s), intensity, decay time, decay intensity, etc., the TPS may be adjusted to "filter out" the effects of extraneous components. For example, the control surface may exhibit substantially little to no luminescence. In such a manner, the control surface may provide a negligible degree of interference with the TPS measurements. Furthermore, even if the control surface did contain a luminescent compound, the excitation light source and/or detector may be adjusted so as to filter out the luminescent wavelengths exhibited by the control surface. Once again, this may be accomplished by specifying the light source, detector, luminescent compound for the toner, or utilizing various filters.

Figure 7:
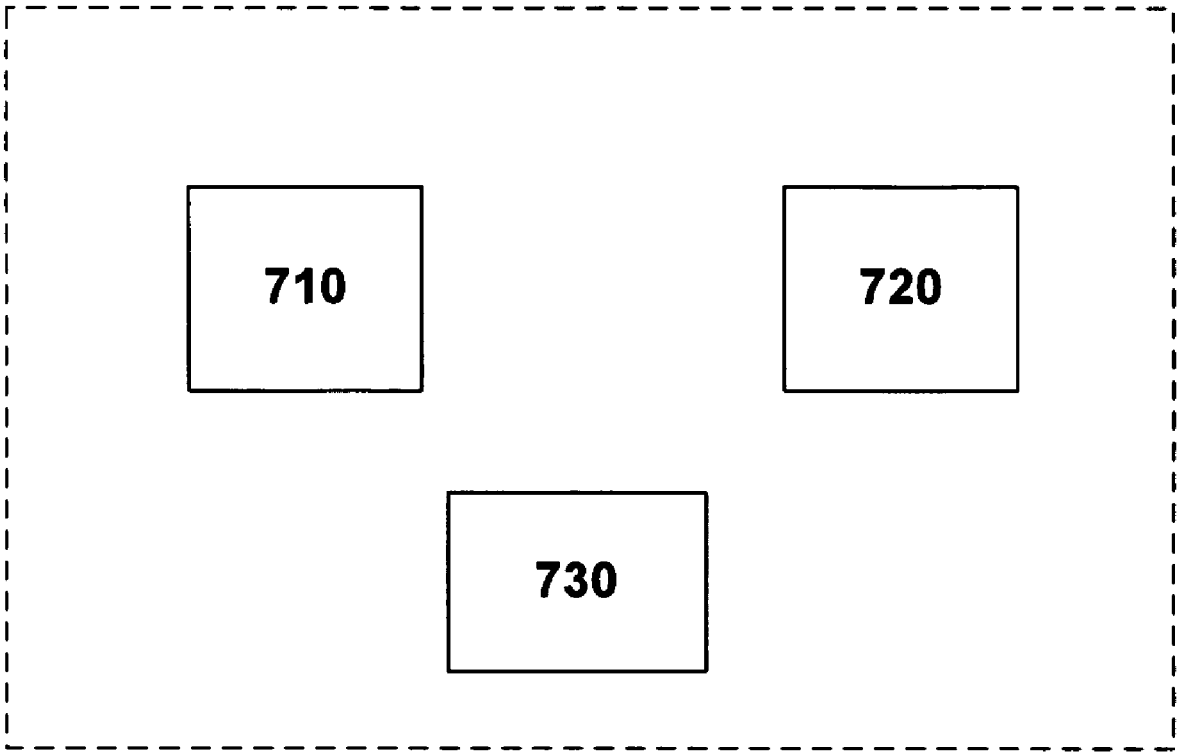
FIG. 7 is a schematic diagram of an example of an article of machine readable media in relation to a processor and a user interface.

It should also be appreciated that the functionality described herein for the embodiments of the present invention may be implemented by using hardware, software, or a combination of hardware and software, either within an image forming device or outside the image forming device, as desired. If implemented by software, a processor and a machine readable medium may be required. The processor may be of any type of processor capable of providing the speed and functionality required by the embodiments of the invention. Machine-readable memory may include any media capable of storing instructions adapted to be executed by a processor. Some examples of such memory include, but are not limited to, read-only memory (ROM), random-access memory (RAM), programmable ROM (PROM), erasable programmable ROM (EPROM), electronically erasable programmable ROM (EEPROM), dynamic RAM (DRAM), magnetic disk (e.g., floppy disk and hard drive), optical disk (e.g. CD-ROM), and any other device that can store digital information. The instructions may be stored on medium in either a compressed and/or encrypted format. Accordingly, in the broad context of the present invention, and with attention to FIG. 7, the image forming device may contain a processor (710) and machine readable media (720) and user interface (730).

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A method comprising:

depositing a toner patch including a toner having a given excitation wavelength and a given emission wavelength onto a control surface;

providing light onto said toner patch from a light source, wherein said provided light is modulated and said light source intermittently ceases to provide said light for a given time period;

detecting at least a portion of light emitted from said toner patch at said given emission wavelength by a detector, wherein said emitted light is not detected until at least 100 ns after said light source has ceased to provide said light; and adjusting an operating parameter of an imaging device based on said detected emitted light, the operating parameter comprising one or more of the following: developer roller bias, photoconductor bias, laser printhead intensity, laser printhead power, and image formation speed.

2. The method of claim 1, wherein said given excitation wavelength is different from said emission wavelength.

3. The method of claim 1, wherein said detector does not detect light provided by said light source.

4. The method of claim 1, wherein said given excitation wavelength is in the range of about 700 nm to about 3,000 nm.

5. The method of claim 1, wherein said given emission wavelength is in the range of about 700 nm to about 3,000 nm.

6. The method of claim 1, wherein said given excitation wavelength is higher than said detector is capable of detecting.

7. The method of claim 1, wherein said given excitation wavelength is lower than said detector is capable of detecting.

8. The method of claim 1, wherein said excitation wavelength is at least 100 nm greater than 1150 nm and said emission wavelength is at least 100 nm less than 1150 nm.

9. An imaging system comprising:

a toner composition having a given excitation wavelength and a given emission wavelength;

a toner patch sensor capable of providing light from a light source onto said toner and detecting at least a portion of light emitted from said toner at said given emission wavelength by a detector and generating a signal, wherein said light source is capable of modulating the light, said light source intermittently ceases to provide light for a given time period and said toner patch sensor begins to detect said emitted light at least 100 ns after said light source has ceased to provide light; and a controller capable of receiving said signal and varying a system operating parameter based on said signal, the operating parameter comprises one or more of the following: developer roller bias, photoconductor bias, laser printhead intensity, laser printhead power, and image formation speed.

10. The system of claim 9, wherein said given excitation wavelength is different from said given emission wavelength.

11. The system of claim 9, wherein said detector does not detect light provided by said light source.

12. The system of claim 9, wherein said given excitation wavelength is in the range of about 700 nm to about 3,000 nm.

13. The system of claim 9, wherein said given emission wavelength is in the range of about 700 nm to about 3,000 nm.

14. The system of claim 9, wherein said toner patch sensor further comprises a filter capable of absorbing or reflecting said light of said given excitation wavelength.

15. The system of claim 9, wherein said light source is capable of providing light of a higher wavelength than said detector is capable of detecting.

16. The system of claim 9, wherein said light source is capable of providing light of a lower wavelength than said detector is capable of detecting.

17. The system of claim 9, wherein said excitation wavelength is at least 100 nm greater than 1150 nm and said emission wavelength is at least 100 nm less than 1150 nm.

* * * * *